US011453135B2

(12) United States Patent
Henn

(10) Patent No.: US 11,453,135 B2
(45) Date of Patent: Sep. 27, 2022

(54) UTILITY KNIFE

(71) Applicant: Kerry Henn, Solingen (DE)

(72) Inventor: Kerry Henn, Solingen (DE)

(73) Assignee: MARTOR KG, Solingen (DE)

( * ) Notice: Subject to any disclaimer, the term of this patent is extended or adjusted under 35 U.S.C. 154(b) by 49 days.

(21) Appl. No.: 17/094,515

(22) Filed: Nov. 10, 2020

(65) Prior Publication Data

US 2021/0170611 A1 Jun. 10, 2021

(30) Foreign Application Priority Data

Nov. 21, 2019 (DE) ..... 102019131546.8

(51) Int. Cl.
*B26B 5/00* (2006.01)
*B26B 1/08* (2006.01)

(52) U.S. Cl.
CPC ..... *B26B 5/003* (2013.01); *B26B 1/08* (2013.01)

(58) Field of Classification Search
None
See application file for complete search history.

(56) References Cited

U.S. PATENT DOCUMENTS 6,148,520 A * 11/2000 Berns ..... B26B 5/003 30/162
7,596,869 B2 * 10/2009 Berns ..... B26B 5/003 30/162
7,765,701 B2 * 8/2010 Okada ..... B26B 5/003 30/162
8,732,957 B2 * 5/2014 Rohrbach ..... B26B 5/003 30/162
10,478,977 B2 11/2019 Rohrbach
2003/0019109 A1 * 1/2003 Tremblay ..... B26B 5/003 30/162
2009/0106983 A1 * 4/2009 Berns ..... B26B 5/003 30/162
2018/0021964 A1 * 1/2018 Rohrbach ..... B26B 1/08 30/162
2021/0170611 A1 * 6/2021 Henn ..... B26B 5/003

FOREIGN PATENT DOCUMENTS

DE 102010019119 A1 11/2011
DE 102010023906 A1 12/2011
DE 102016000724 A1 7/2017
EP 3 827 938 A1 * 6/2021

* cited by examiner

*Primary Examiner* — Hwei-Siu C Payer
(74) *Attorney, Agent, or Firm* — Andrew Wilford

(57) ABSTRACT

A utility knife has a housing, a blade holder movable between a front position and a rear position in the housing, and first and second return formations of which one is mounted on the housing and the other on the blade holder. The first and second return formations urge the blade holder into the rear position relative to the housing in at least one region of movement of the blade holder. The first return formation includes a spring and a movable element connected to the spring and urged thereby in a travel direction of the movable element. The second return formation includes a counter surface engageable with the movable element.

13 Claims, 5 Drawing Sheets

UTILITY KNIFE

FIELD OF THE INVENTION

The invention relates to a utility knife.

BACKGROUND OF THE INVENTION

Such a utility knife is known from DE 10 2016 008 724 [U.S. Pat. No. 10,478,977]. It comprises a housing and a blade holder relatively movable between a rear position and a cutting position. A return device in the form of a spring urges the blade holder into the rear position. In the rear position, the blade is retracted into the housing to the extent that the user cannot touch the cutting edge and therefore cannot injure himself. In the cutting position, the blade projects out of the front opening in the housing such that a cutting process is possible.

OBJECT OF THE INVENTION

The object of the invention is to design the return device such that it can be produced in a cost-effective manner. Furthermore, the return device is intended to allow the utility knife to be assembled in a simple manner. In addition, the return device is intended to be configured such that the return force can be varied by simply altering the construction.

SUMMARY OF THE INVENTION

The utility knife of this invention comprises a housing and a blade holder relatively movable between a first position and a second position. The first position is e.g. a rear safety position in which the blade is contained in the housing such that a user cannot touch the cutting edge of the blade. The second position is e.g. a blade-change position in which the blade extends out of the housing such that it is possible to change the blade. The second position may e.g. alternatively also be a cutting position in which the blade is moved out of the housing to the extent that a cutting process is possible.

Movement of the blade holder may e.g. be straight-line, rotary, or of a mixed nature with straight-line and rotary components. The blade holder may e.g. be movable on a straight or curved path.

In addition, the utility knife comprises a return device comprising a spring that can urge the blade holder into the first position relative to the housing.

The housing may have multiple parts. In particular if these parts are immovable relative to other housing parts and are rigidly connected thereto, they shall fall under the term "housing" in the following.

The return device comprises first return means and second return means. The first return means are mounted on the housing or blade holder. The second return means are mounted on the other element, i.e. on the blade holder or the housing. The first return means comprise a movable element and a spring. The movable element is connected to the spring and is urged in a travel direction by the spring. The movable element can e.g. perform a rotary movement, a straight-line movement, or a mixed movement having rotary and straight-line components. The movable element interacts with the blade holder and the housing and urges the blade holder toward the rear position at least in one movement region of the blade holder.

The movable element e.g. has a contact surface, which is in contact with a counter surface of the housing or the blade holder and is movable relative to the counter surface. The second return means comprise the counter surface. If e.g. the first return means are mounted on the blade holder, the contact surface is in contact with the second return means of the housing. If the first return means are mounted on the housing, the contact surface is in contact with the second return means of the blade holder.

The counter surface e.g. comprises at least two regions, with a second region having a different orientation from the first region. The movable element is in engagement with one of the at least two regions of the counter surface, for example depending on the position of the blade holder. The counter surface e.g. forms a sliding path, and the contact surface is a sliding surface. Alternatively, the contact surface could for example be formed on a rolling element, and the counter surface forms a rolling path.

The contact surface may e.g. be formed on a projection of the movable element.

The spring is e.g. a compression spring or a tension spring. Springs of this kind are affordably available on the market in different sizes. In particular, a tension spring is simple to mount and can be easily fastened to the components to be urged.

Within the meaning of the invention, a spring is any device made of an elastically deformable material which exerts a return force after the deformation. As long as this property is provided, the term is not dependent on the shape and the material of the device. The spring may e.g. be made of spring steel, plastics material, or a natural substance.

The movable element interacts e.g. with differently oriented surfaces of the housing or blade holder, which form the counter surface. The orientation of the surface is indicated in the following by the direction of the surface orthogonal. The orientation of the different surface regions may be such that different components of the spring force act on the blade holder in the return direction (direction of the first position). For example, a first force acts on the blade holder in the return direction between the first position and an intermediate position, and a second force or no force acts on the blade holder in the return direction between the intermediate position and the second position. The first force differs from the second force.

The blade holder can e.g. be moved between a first, safety position, a cutting position, and a second, blade-change position.

The position of the blade holder e.g. controls the contact of the movable element with the relevant region of the counter surface.

For example, when moving the blade holder between the rear position and the cutting position, the movable element can be in contact with a counter surface, which urges the blade holder into the rear position. In the blade-change position, the movable element can be in contact with a counter surface such that the blade holder is not urged in the return direction or is only urged in the return direction with a low force, and therefore no movement takes place. This may e.g. be the case if the blade holder is urged in a direction in which it does not have a degree of freedom.

In a second region of the counter surface, the force acting on the blade holder in the return direction may e.g. be less than in a first region. The first region includes the safety position, for example. The second region includes the cutting position, for example.

A first surface, e.g. a surface of the blade holder or the housing which is in contact with the movable element, is e.g. directed in the travel direction of the blade holder such that the blade holder is urged into the rear position. The surface orthogonal is e.g. parallel with the travel direction of the blade holder or has components that are similarly parallel.

A second surface, e.g. a surface of the blade holder or the housing, which is in contact with the movable element, is e.g. directed relative to the travel direction of the blade holder such that the blade holder is not urged into the rear position or is urged into the rear position with less force. The surface orthogonal is e.g. directed at right angles to the travel direction of the blade holder or has components that are directed in such a manner. If the surface orthogonal is directed at right angles to the travel direction of the blade holder, the movable element cannot transfer any force to the blade holder in the direction of the rear position. Therefore, the blade holder remains in the set position. In this case, a proportion of the spring force is directed in a direction other than the return direction and is e.g. absorbed by the housing.

The counter surface is e.g. formed as a control surface over which the movable element travels when the blade holder moves between the rear position and the blade-change position. At least two differently oriented surfaces are e.g. formed on one counter surface. In this case, the first return means are mounted on the housing or the blade holder and the counter surface of the second return means is mounted on the other element, i.e. the blade holder or the housing. A guide element of the movable element can be guided on the counter surface. Depending on the orientation of the counter surface with which the movable element is in contact, the blade holder is urged into the rear position with the full spring force if the entirety of the spring force is acting on the blade holder in the return direction, is urged into the rear position with less force if only some of the spring force is acting on the blade holder in the return direction, or is not urged into the rear position at all if the spring force is not acting on the blade holder in the return direction. In this sense, spring force is the spring force transferred from the movable element to the blade holder.

The movable element is e.g. a lever, for example a two-armed lever. The lever is pivotable about a fixed pivot axis or a movable pivot axis. A lever arm e.g. comprises the contact surface. For example, a second lever arm is urged by the spring.

For example, the spring and the movable element are fastened to the blade holder, with one end of the spring being connected to the blade holder and the other end of the spring being connected to the movable element.

Alternatively, the spring and the movable element are fastened to the housing, and one end of the spring is connected to the housing and the other end of the spring is connected to the movable element.

The housing is e.g. provided with at least one first stop and the blade holder is provided with a counter-stop. In this case, the contact between the stop and the counter-stop determines the cutting position, for example. This means that the blade holder can only be moved out of the rear position toward the cutting position until the stop and the counter-stop are in contact and therefore determine the cutting position.

For example, the housing is provided with a second stop, which is in contact with the counter-stop in a blade-change position and prevents any further movement in the travel direction counter to the rear position. In the blade-change position, the blade holder is e.g. moved beyond the cutting position relative to the rear position.

For example, a stop on the housing which defines the cutting position can be reached via a first movement path and a stop which defines the blade-change position can be reached via a second movement path. For example, a region of the blade holder is flexibly movably mounted such that the counter-stop can be moved between the first movement path and the second movement path. The counter-stop can e.g. be shifted between the movement paths by means of actuation. If the counter-stop is then moved on the first movement path, movement of the first stop is limited, and if the counter-stop is moved on the second movement path, movement of the second stop is limited.

The first movement path and the second movement path can be separated from one another by a wall such that the counter-stop cannot move between the first movement path and the second movement path, at least in one movement region. For example, the counter-stop can be moved between the first movement path and the second movement path in the rear position.

One embodiment of the invention is described by way of example in the following description of the figures, also with reference to the schematic drawings. Here, for the sake of clarity, even if different embodiments are involved, identical or comparable parts or elements or regions have been denoted by identical reference signs, sometimes with the addition of lower-case letters or apostrophes.

Features that are only described, set out or disclosed in relation to one embodiment can also be provided in any other embodiment of the invention within the scope of the invention. Even if they are not shown in the drawings, such amended embodiments are covered by the invention.

All the features disclosed are essential to the invention per se. The content of the disclosure of the cited documents and the prior art devices described are hereby incorporated into the disclosure of the application in their entirety, also for the purpose of incorporating individual features or a plurality of features of the subjects disclosed therein into one or more claims of the present application. Even if they are not shown in the drawings, such amended embodiments are also covered by the invention.

SPECIFIC DESCRIPTION OF THE INVENTION

Figure 1:
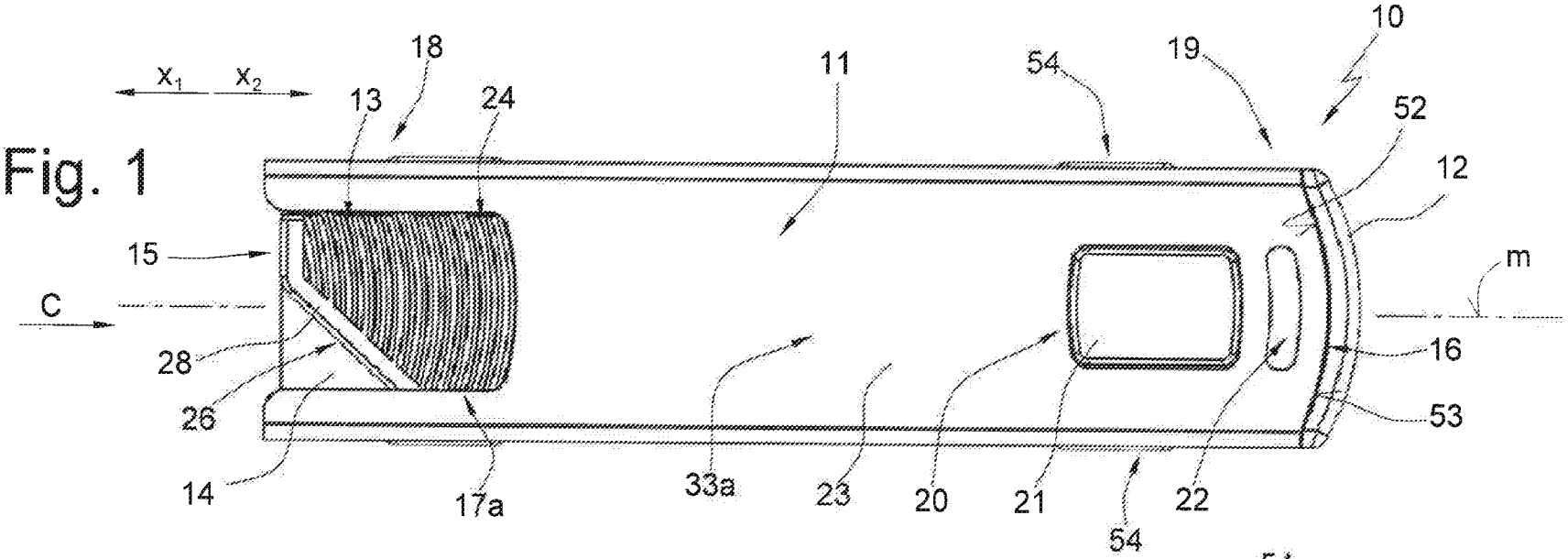
FIG. 1 is a side view of the completely assembled utility knife, with the blade holder being in a rear position.

The utility knife as a whole is denoted by reference sign 10 in the drawings.

According to FIG. 1, a first embodiment of the utility knife 10 comprises a housing 11 having a first housing part 12 and a second housing part 23. In addition, the utility knife 10 comprises a blade holder 13 having a blade 14, which is provided with a cutting edge 25. In the present embodiment, the housing part 23 is a sleeve and comprises a front opening 15 and a rear opening 16. A central longitudinal axis of the utility knife 10 is denoted by m.

For actuating the blade holder 13, recesses 17*a* and 17*b* are also formed on either side in the housing part 23 in a front end region 18 of the utility knife 10. Two recesses are provided in the housing part 23 in a rear end region 19 of the utility knife 10, of which one recess 20 is used for actuating an actuating element 21 and the other recess 22 forms a through-opening that is used for hanging up the utility knife 10.

In the present embodiment, the housing part 23 is a sheet-metal part, but can also be made of other materials and have a different shape. The invention does not come down to the material and external design of the housing, as becomes clear in the following.

Figure 2:
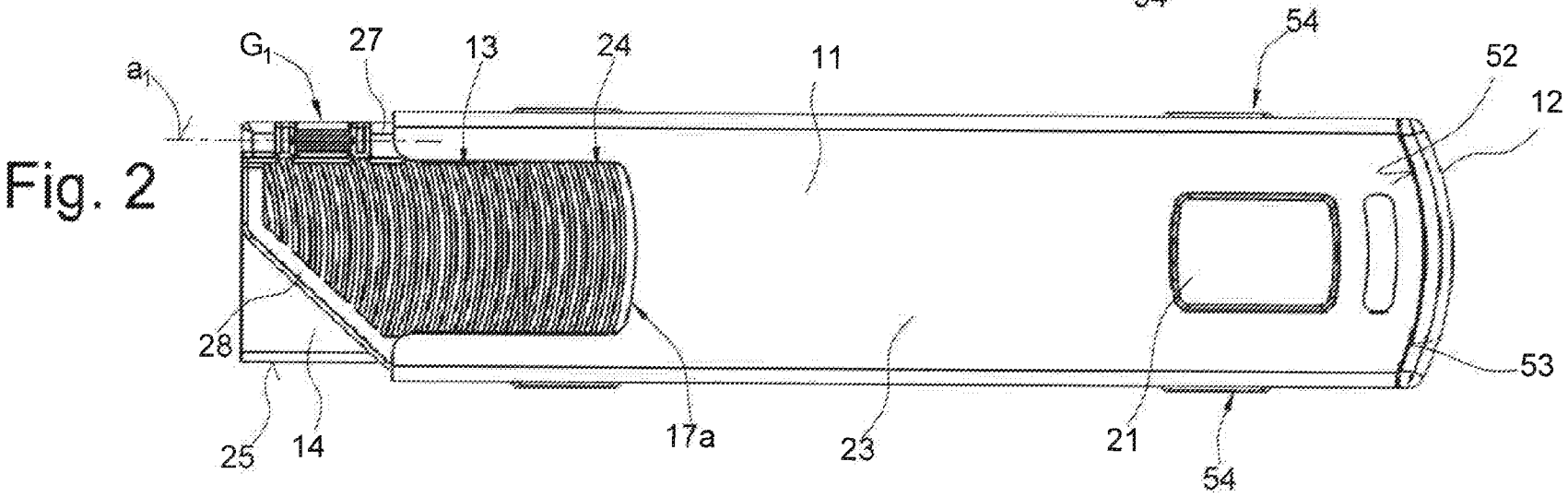
FIG. 2 shows the utility knife based on FIG. 1, with the blade holder being in a cutting position.

According to FIG. 1, the blade holder 13 is in the rear position. By the blade holder 13 being gripped by the recesses 17*a* and 17*b*, the blade holder 13 can be shifted relative to the housing 11 out of the rear position in the direction $x_1$ into a cutting position, which is shown in FIG. 2. When the force on the blade holder 13 is decreased, the blade holder 13 is automatically moved into the rear position by a return device 34 when it is in a position between the rear position and the cutting position, with this including the cutting position.

In order to prevent fingers from slipping, the blade holder 13 has a structure 24 that gives the fingers good grip on either side in its front end region.

In addition, the blade holder 13 has an oblique cut-away portion 26, which exposes a region of the cutting edge 25 of the blade 14. In the present embodiment, the utility knife 10 has a rectangular blade 14, but any blade shape, such as a trapezoidal blade, hook blade, etc., can be used in principle.

FIG. 1 also shows that the housing part 23 forms beads 54, which form recessed portions in the interior of the housing part 23, into which the housing part 12 can be latched.

Figure 3:
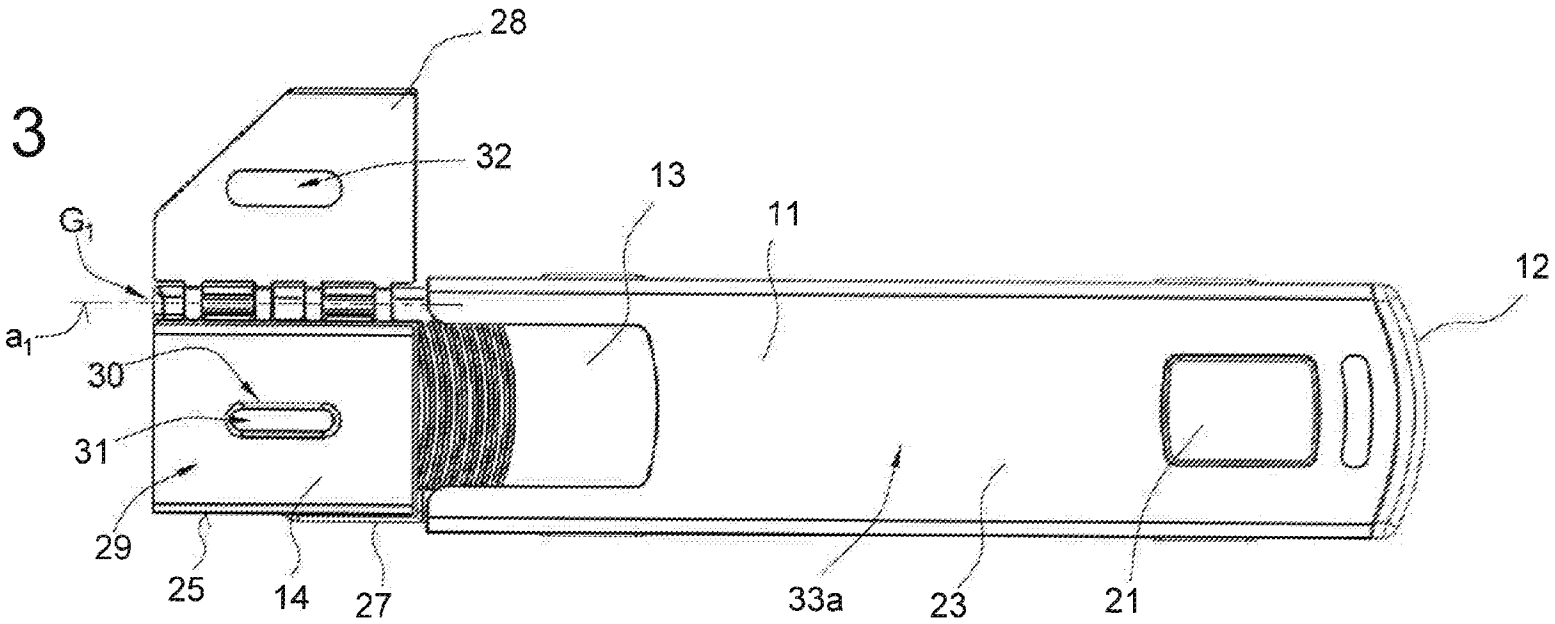
FIG. 3 shows the utility knife based on FIG. 1, with the blade holder being in a blade-change position and a blade cover being pivoted out from the blade seat.

According to FIG. 3, the blade holder 13 is moved beyond the cutting position in the direction x1 into a blade-change position. The blade holder 13 can only be moved beyond the cutting position when the actuating element 21 has previously been actuated. In a known manner, the blade holder 13 comprises a main part 27, in which a blade seat 29 is formed, and a cover part 28, which forms a pivot joint $G_1$ together with the main part 27. The blade 14 is held between the main part 27 and the cover part 28. In the blade-change position, it is possible to pivot the cover part 28 about a pivot axis $a_1$ away from a blade seat 29, out of a closed position according to FIGS. 1 and 2 into an open position according to FIG. 3.

FIG. 3 shows that the blade 14 is provided with a slot-shaped opening 30 and the blade seat 29 comprises a complementary projection 31, which engages through the blade 14 and can penetrate into a recessed portion 32 of the cover part 28 when the cover part 28 in is in the closed position. In this way, the blade 14 can be held in the blade holder 13 in a form-fitting manner. When the cover part 28 is in the open position, it is possible to remove the blade 14 from the blade seat 29 and replace it with a new blade 14.

When the blade holder 13 is between the rear position and the cutting position, the cover part 28 is held in the closed position by opposite side walls 33*a* and 33*b* (not in the drawings) of the housing 11.

Figure 4:
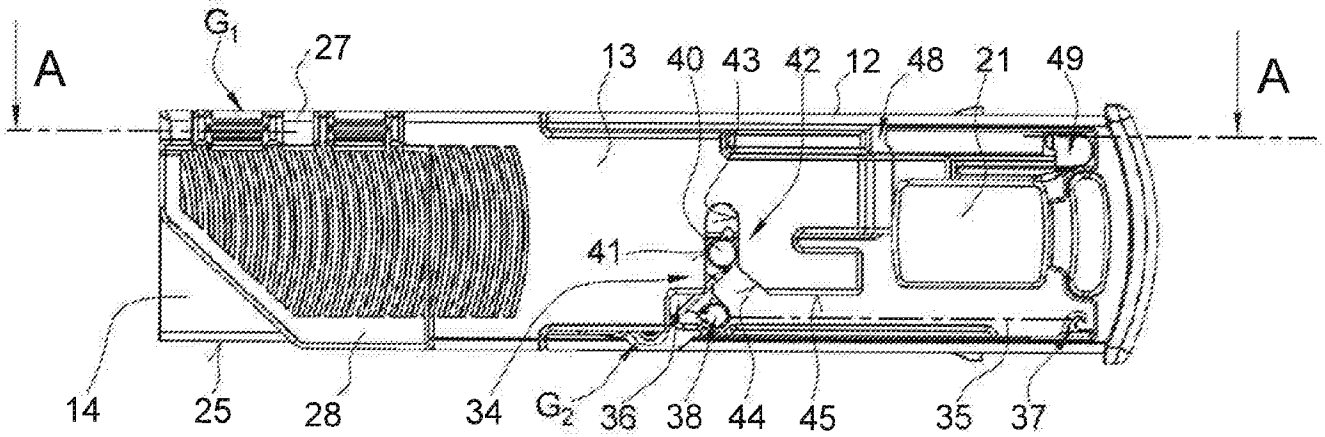
FIG. 4 is a side view of the utility knife according to FIG. 1, with a housing part not being shown.

FIG. 4 shows the utility knife 10 without the housing 11, with the blade holder 13 being in the rear position according to FIG. 1. A return device 34 urges the blade holder 13 into the rear position when the blade holder 13 is in the rear position, the cutting position, or between said positions.

The rear position is defined by the contact between stop shoulders 46 of the blade holder 13 and a surface 47 of the first housing part 12 (cf. FIG. 4). First return means of the return device 34 comprise a spring 35, which is only indicated by a dashed-dotted line in FIGS. 4, 5 and 6. In addition, the first return means of the return device 34 comprise a movable element, in the form a lever 36 here. The spring 35 comprises a tension spring in the shape of a helical spring. One end of this spring is attached to a spring fastening 37 on the first housing part 12 and the other end of this spring is attached to a spring fastening 38 on the lever 36.

The lever 36 is mounted on the first housing part 12 so as to be pivotable about a pivot axis $a_2$ in the directions $u_1$ and $u_2$ and forms a pivot joint $G_2$ together with the first housing part 12. The spring 35 urges the lever 36 in the direction $u_2$. In the rear position according to FIG. 4, the spring 35 is subjected to pre-tensioning. The lever 36 comprises a projection 40, which is formed as a cylindrical pin in the present embodiment, but can also have a different design. An outer surface 41 of the projection 40 is in contact with a counter surface 42 of the blade holder 13. Second return means comprise the counter surface.

In the present embodiment, the counter surface 42 forms a control surface that can influence the proportion of the spring force of the spring 35 depending on the position of the projection 40 relative to the counter surface, and this urges the blade holder 13 in the direction $x_2$.

The counter surface 42 of the blade holder 13 comprises a surface region 43 of which the surface orthogonal is directed approximately in parallel with the travel directions $x_1$ and $x_2$ of the blade holder 13. In addition, the counter surface 42 comprises a surface region 45 of which the surface orthogonal is directed approximately at right angles to the travel directions $x_1$ and $x_2$. A transition region 44 has an angle of approx. 45° to the region 43 and the region 45. The transition region 44 is arranged along the counter surface 42 between the surface regions 43 and 45 in relation to the travel directions of the projection 40.

Figure 5:
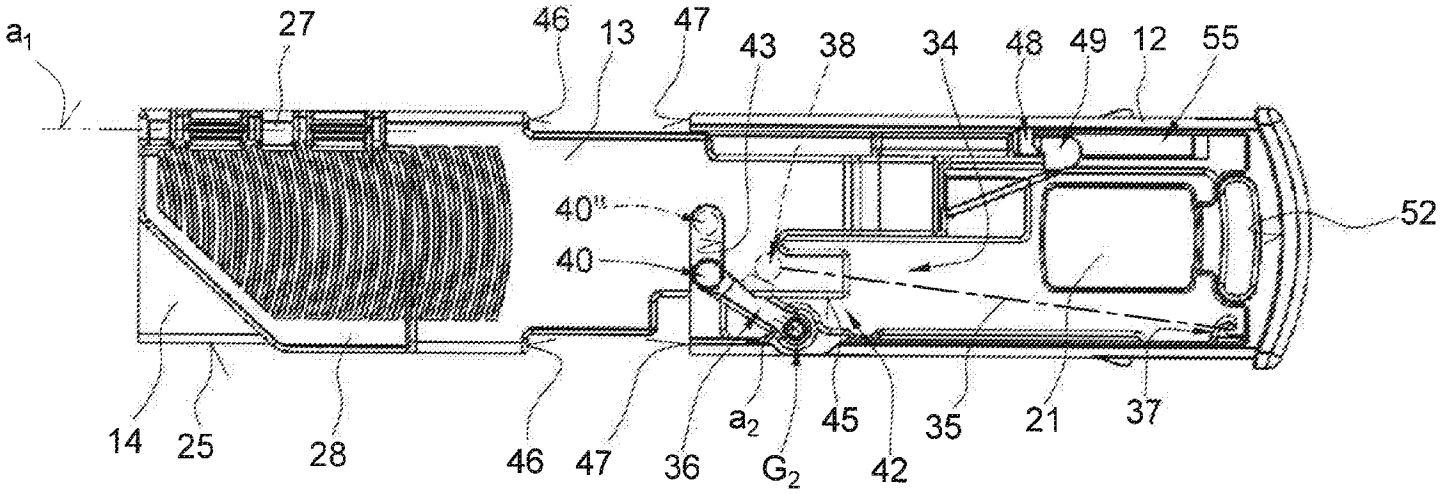
FIG. 5 is a side view of the utility knife according to FIG. 2, with a housing part not being shown.
Figure 6:
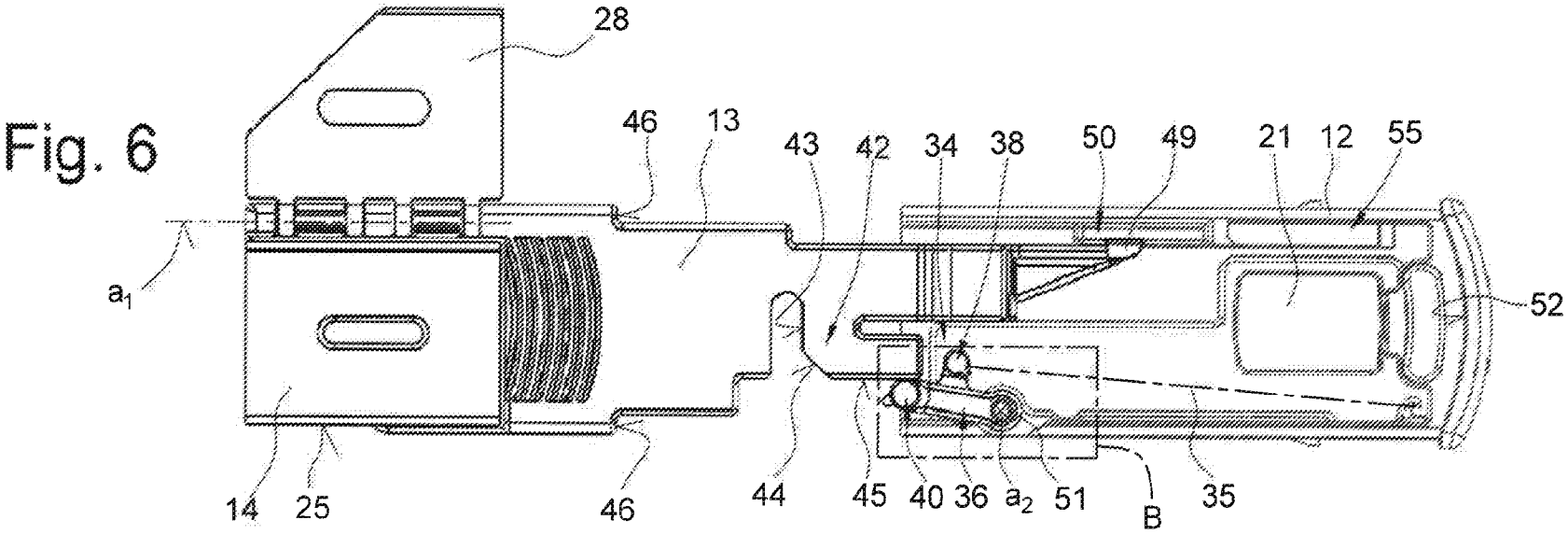
FIG. 6 is a side view of the utility knife according to FIG. 3 with a housing part not being shown.
Figure 7:
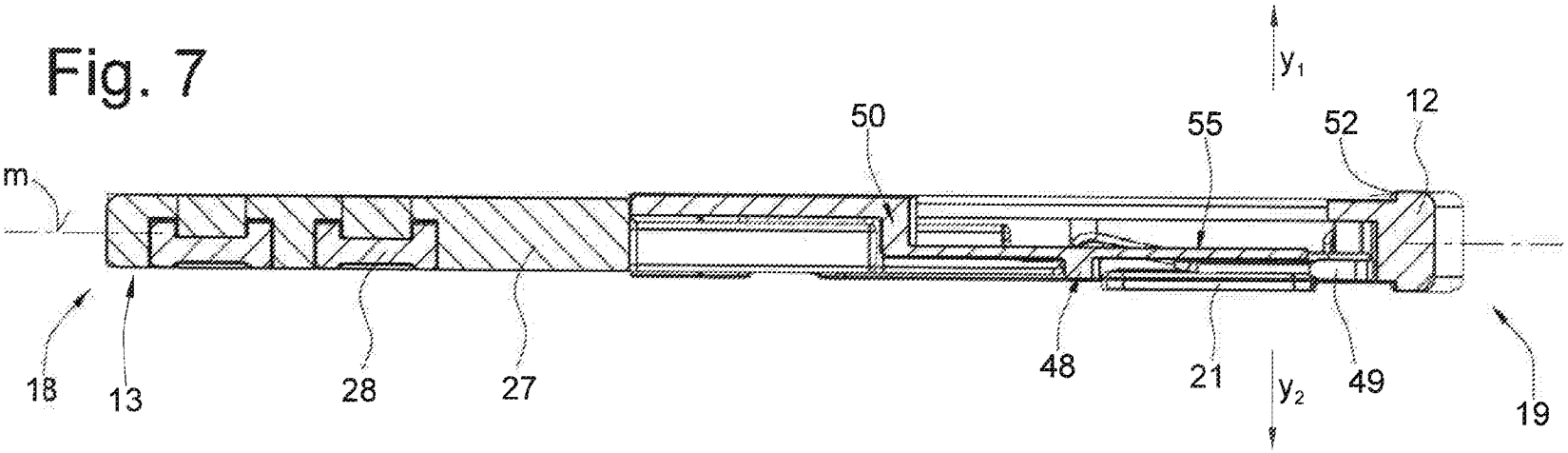
FIG. 7 is a sectional view along sectional line A-A in FIG. 4.
Figure 9:
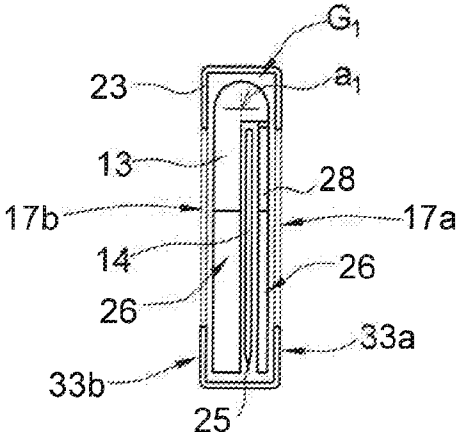
FIG. 9 is a front view from the direction of the arrow C in FIG. 1.
Figure 8:
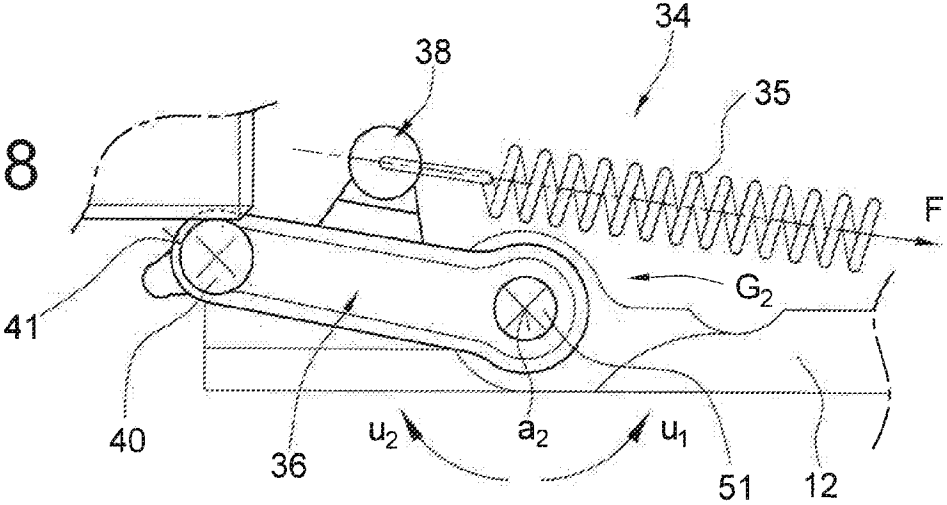
FIG. 8 shows a detail according to detail line B in FIG. 6.

While the blade holder 13 is moving out of the rear position according to FIG. 4 into the cutting position according to FIG. 5, the outer surface 41 of the projection 40 abuts the first region 43 of the counter surface 42. Owing to the rotary movement of the lever 36 in the direction $u_1$ counter to the force of the spring 35 in the direction $u_1$, the projection 40 moves out of the position according to FIG. 4, through the position denoted by 40" in FIG. 5, into the position denoted by 40 in FIG. 5.

The cutting position is reached when an extension 49 of the blade holder 13 has moved on a first movement path into contact with a counter surface of a first stop 48 on the first housing part 12.

If the blade holder 13 is to be moved into a blade-change position, the first stop 48 can be moved by means of the actuating element 21 in a resilient manner in the direction $y_1$ on a second movement path, which is separated from the first movement path by a wall 55. The blade holder 13 can then be moved on the second movement path into the blade-change position according to FIG. 6. Movement of the blade holder 13 in the direction $x_1$ is limited by the contact between the surface of the extension 49 and a holding surface of a second stop 50. If the blade holder 13 is moved back into the rear position in the direction $x_2$, the extension 49 is automatically moved back onto the first movement path due to its resilient return force.

While the blade holder 13 is moving between the cutting position and the blade-change position, the projection 40 slides from the first region 43, through the transition region 44, onto the second region 45. The surface orthogonal of the second region 45 is directed at right angles to the travel directions $x_1$, $x_2$ of the blade holder 13, such that no forces can be transferred from the lever 36 to the blade holder 13 which load the blade holder in the direction $x_2$. The blade can therefore be changed without the blade holder 13 having to be held in the blade-change position counter to the spring force of the spring 35. The spring force that is transferred from the lever 36 to the blade holder is absorbed by the housing part 23 in this position of the projection 40.

Once the blade change is completed, the blade holder 13 is moved out of the blade-change position manually relative to the first housing part 12 in the direction $x_2$. The projection 40 then slides in the opposite direction from the region 45 of the counter surface 42, through the transition region 44, onto the region 43. When the transition region 44 is reached, the lever 36 again exerts a force in the direction $x_2$ on the blade holder 13, such that the further movement of the blade holder 13 in the direction $x_2$ until it reaches the rear position no longer has to be actively performed by the user, but instead takes place automatically by means of the return force of the spring 35 which urges the lever 36 in the direction $u_2$. The rear position is reached when the stop shoulders 46 abut the surfaces 47 of the second housing part 23.

The utility knife is assembled as follows, for example. The lever 36 is put onto a pin 51 of the first housing part 12 forming the pivot axis $a_2$. The spring 35 is fastened to the lever 36 and the first housing part 12. The cover part 28 is mounted on the main part 27 of the blade holder 13.

The blade holder 13 is then inserted into the first housing part 12 and the projection 40 of the lever 36 is brought into contact with the region 45. By being inserted further in the direction $x_2$, said blade holder comes into contact with the transition region 44, at which point the blade holder 13 is automatically moved into the rear position.

The unit made up of the first housing part 12 and the blade holder 13 can then be inserted into the rear opening 16 in the housing 11 until a stop surface 52 of the first housing part 12 abuts a rear end face 53 of the housing 11 and the housing part 12 is latched to the housing part 23.

The blade 14 can then be mounted by the blade holder 13 being moved into the blade-change position as described above.

Figure 10:
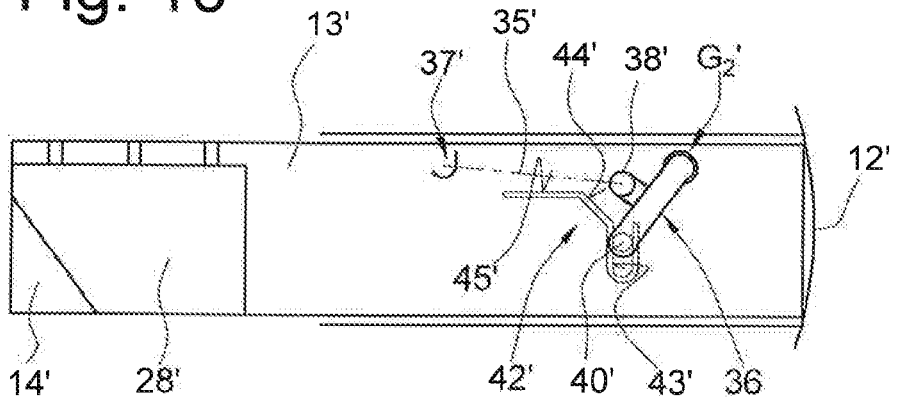
FIG. 10 is a side view of a second embodiment of the utility knife based on FIG. 4 in the rear position, with the return device being formed on the blade holder and the counter surface being formed on the housing.
Figure 11:
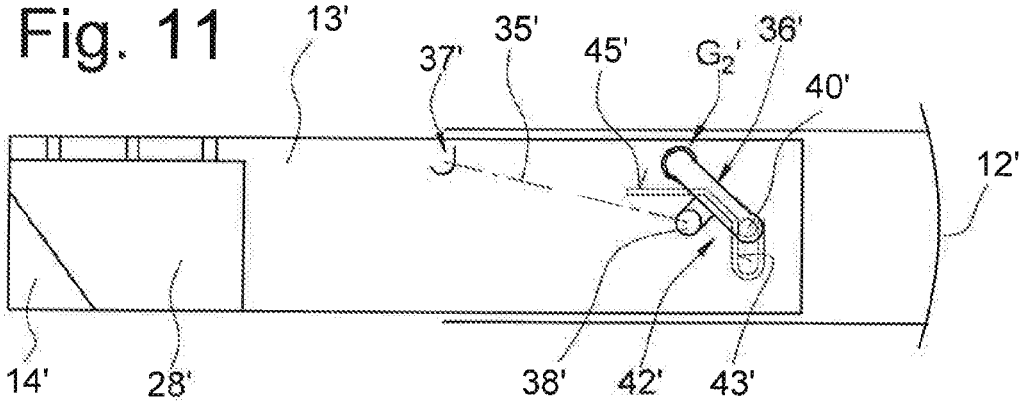
FIG. 11 is a side view of the second embodiment based on FIG. 5 in the cutting position.
Figure 12:
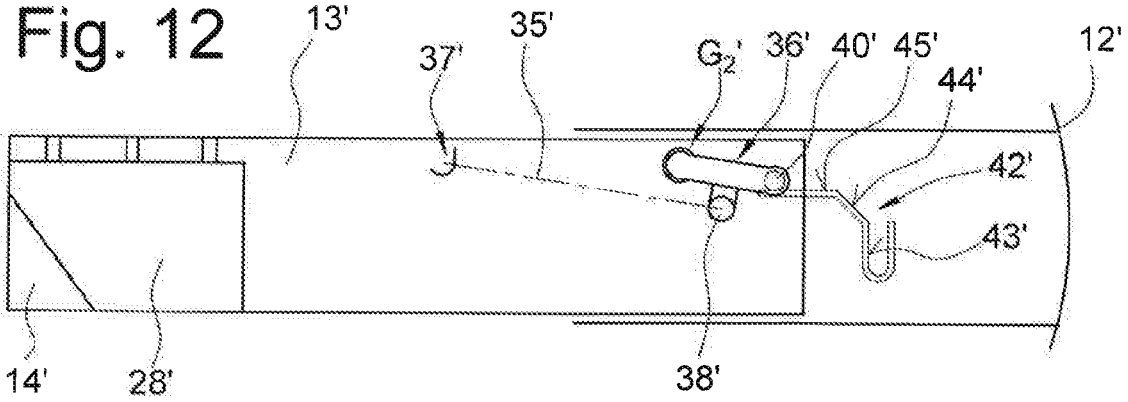
FIG. 12 is a side view of the second embodiment based on FIG. 6 in the blade-change position.

FIGS. 10 to 12 show a second embodiment of the utility knife, which only differs from the first embodiment in that the spring 35' and the lever 36' are formed on the blade holder 13' and the control surface 42' is formed on the housing part 12'. Otherwise, the corresponding components or elements have been provided with the numbers that have also been used in the first embodiment, with these numbers additionally containing an apostrophe.

The invention claimed is:

1. A utility knife comprising:

a housing;

a blade holder movable between a front position and a rear position in the housing; and first and second return means of which one is mounted on the housing and the other is mounted on the blade holder, the first and second return means urging the blade holder into the rear position relative to the housing in at least one region of movement of the blade holder, the first return means including a spring and a movable element connected to the spring and urged thereby in a travel direction of the movable element, the second return means including a counter surface engageable with the movable element.

2. The utility knife according to claim 1, wherein the spring is a compression spring or a tension spring.

3. The utility knife according to claim 1, wherein the movable element interacts with the counter surface and the counter surface has a first surface directed in the travel direction of the blade holder such that the blade holder is urged with a first force in a first force range into the rear position.

4. The utility knife according to claim 3, wherein a second surface of the counter surface is directed in the travel direction of the blade holder such that the blade holder is urged with a second force in a second force range into the rear position.

5. The utility knife according to claim 4, wherein the second force range is less than the first force range and differs from the first force range.

6. The utility knife according to claim 1, wherein the surface is part of a control path traveled during movement of the blade holder between the rear position and a blade-change position.

7. The utility knife according to claim 1, wherein the movable element is a lever.

8. The utility knife according to claim 1, wherein the spring and the movable element are fastened to the blade holder, and one end of the spring is connected to the blade holder and another end of the spring is connected to the movable element.

9. The utility knife according to claim 1, wherein the spring and the movable element are fastened to the housing, and one end of the spring is connected to the housing and another end of the spring is connected to the movable element.

10. The utility knife according to claim 1, wherein the housing is provided with a first stop and a second stop and the blade holder is provided with a counter-stop, the first stop contacting the counter-stop in the front position and the second stop contacting the counter-stop in a blade-change position.

11. The utility knife according to claim 10, wherein the counter-stop can be moved toward the first stop on a first movement path and toward the second stop on a second movement path.

12. The utility knife according to claim 11, wherein the first movement path and the second movement path are separated by a wall at least in one region of movement of the counter-stop.

13. The utility knife according to claim 12, wherein the counter-stop and/or the wall are flexibly mounted such that the counter-stop can be moved between the first movement path and the second movement path.

* * * * *